US007390598B2

(12) United States Patent
Mishra et al.

(10) Patent No.: US 7,390,598 B2
(45) Date of Patent: Jun. 24, 2008

(54) PHOTORECEPTOR WITH THREE-LAYER PHOTOCONDUCTIVE LAYER

(75) Inventors: Satchidanand Mishra, Webster, NY (US); Yuhua Tong, Webster, NY (US); Anthony M. Horgan, Pittsford, NY (US); Kathleen M. Carmichael, Williamson, NY (US); Dennis J. Prosser, Walworth, NY (US); Richard L. Post, Penfield, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 438 days.

(21) Appl. No.: 11/167,594

(22) Filed: Jun. 28, 2005

(65) Prior Publication Data

US 2006/0292466 A1 Dec. 28, 2006

(51) Int. Cl.
*G03G 15/02* (2006.01)

(52) U.S. Cl. ..... 430/58.05; 430/57.1

(58) Field of Classification Search ..... 430/58.05, 430/57.1

See application file for complete search history.

(56) References Cited

U.S. PATENT DOCUMENTS

| | | | |
|---|---|---|---|
| 3,121,006 | A | 2/1964 | Middleton et al. |
| 3,357,989 | A | 12/1967 | Byrne et al. |
| 3,442,781 | A | 5/1969 | Weinberger |
| 4,081,274 | A | 3/1978 | Horgan |
| 4,115,116 | A | 9/1978 | Stolka et al. |
| 4,233,384 | A | 11/1980 | Turner et al. |
| 4,265,990 | A | 5/1981 | Stolka et al. |
| 4,291,110 | A | 9/1981 | Lee |
| 4,299,897 | A | 11/1981 | Stolka et al. |
| 4,304,829 | A | 12/1981 | Limburg et al. |
| 4,306,008 | A | 12/1981 | Pai et al. |
| 4,415,639 | A | 11/1983 | Horgan |
| 4,439,507 | A | 3/1984 | Pan et al. |
| 4,464,450 | A | 8/1984 | Yeuscher |
| 4,647,521 | A | 3/1987 | Oguchi et al. |
| 4,664,995 | A | 5/1987 | Horgan et al. |
| 4,713,308 | A | 12/1987 | Yoshizawa et al. |
| 4,855,203 | A | 8/1989 | Badesha et al. |
| 5,008,167 | A | 4/1991 | Yu |
| 5,521,047 | A | 5/1996 | Yuh et al. |
| 5,576,130 | A | 11/1996 | Yu et al. |
| 5,591,554 | A | 1/1997 | Mishra et al. |
| 5,607,802 | A | 3/1997 | Mishra et al. |
| 5,703,487 | A | 12/1997 | Mishra |
| 5,709,974 | A | 1/1998 | Yuh et al. |
| 5,830,614 | A | 11/1998 | Pai et al. |
| 5,882,829 | A | 3/1999 | Hsieh et al. |
| 5,891,594 | A | 4/1999 | Yuh et al. |
| 6,008,653 | A | 12/1999 | Popovic et al. |
| 6,119,536 | A | 9/2000 | Popovic et al. |
| 6,214,514 | B1 | 4/2001 | Evans et al. |
| 6,350,550 | B1 | 2/2002 | Mishra et al. |
| 6,376,141 | B1 | 4/2002 | Mishra et al. |
| 2004/0126684 | A1 | 7/2004 | Horgan et al. |
| 2004/0229141 | A1 * | 11/2004 | Goodbrand et al. ..... 430/58.05 |

* cited by examiner

*Primary Examiner*—John L Goodrow
(74) *Attorney, Agent, or Firm*—Oliff & Berridge, PLC

(57) ABSTRACT

An imaging member includes a conductive substrate, a charge generating layer, a charge transport layer, and an intermediate layer between the charge generating layer and the charge transport layer, the intermediate layer including a hole transport material, such as three different hole transfer materials, dispersed in a film forming binder, such as two different binder materials.

21 Claims, 2 Drawing Sheets

PHOTORECEPTOR WITH THREE-LAYER PHOTOCONDUCTIVE LAYER

BACKGROUND

The present disclosure relates to improved photoreceptor designs for electrostatographic printing devices, particularly photoreceptors having a three-layer photoconductive layer, where an intermediate layer is disposed between the charge generating layer and the charge transport layer, which provides improved photoreceptor operation. More particularly, the present disclosure relates to photoreceptors having an intermediate layer between the charge generating layer and the charge transport layer, which intermediate layer increases charge injection from the charge generating layer to the charge transport layer and reduces the occurrence or the effect of charge deficient spots in the photoreceptor.

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light or a laser emission. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer, a ground plane, and two active layers. These active layers generally include (1) a charge generating layer containing a light-absorbing material that generates charges, and (2) a charge transport layer containing electron donor molecules. These charge generating and charge transport active layers can be in any order, depending on the desired charge polarity, and sometimes can be combined in a single or mixed layer. The substrate layer may be formed from a conductive material, or a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder largely provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating layer and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

As more advanced, higher speed electrophotographic copiers, duplicators and printers have been developed, and as the use of such devices increases in both the home and business environments, degradation of image quality has been encountered during extended cycling. Moreover, complex, highly sophisticated duplicating and printing systems operating at very high speeds have placed stringent requirements upon component parts, including such constraints as narrow operating limits on the photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles without degradation in the print quality or mechanical disintegration such as cracking and abrasion. One type of multilayered photoreceptor that has been employed for use as a belt or as a roller in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Although excellent toner images may be obtained with multilayered belt or drum photoreceptors, it has been found that as more advanced, higher speed electrophotographic copiers, duplicators and printers are developed, there is a greater demand on copy quality. A delicate balance in charge, discharge, and bias potentials, and characteristics of the toner and/or developer, must be maintained. This places additional constraints on the quality of photoreceptor manufacturing, and thus adds an additional constraint on manufacturing yield.

In certain combinations of materials for photoreceptors, or in certain production batches of photoreceptor materials including the same kind of materials, localized microdefect sites (which may vary in size from about 50 to about 200 microns) can occur. Using photoreceptors fabricated from these materials, where the dark decay is high compared to spatially uniform dark decay present in the sample, these sites appear as print defects (microdefects) in the final imaged copy. In charged area development, where the charged areas are printed as dark areas, the sites print out as white spots. These microdefects are called microwhite spots. Likewise, in discharged area development systems, where the exposed area (discharged area) is printed as dark areas, these sites print out as dark spots in a white background. All of these microdefects, which exhibit inordinately large dark decay, are called charge deficient spots (or CDS).

Because the microdefect sites are fixed in the photoreceptor, the spots are registered from one cycle of belt revolution to the next. Whether these localized microdefect or charge deficient spot sites will show up as print defects in the final document will depend on the development system utilized and, thus, on the machine design selected. For example, some of the variables governing the final print quality include the surface potential of the photoreceptor, the image potential of the photoreceptor, the photoreceptor to development roller spacing, toner characteristics (such as size, charge and the like), the bias applied to the development rollers, and the like. The image potential depends on the light level selected for exposure. The defect sites are discharged, however, by the dark discharge rather than by the light. The copy quality from generation to generation is maintained in a machine by continuously adjusting some of the parameters with cycling. Thus, defect levels could also change with cycling.

Furthermore, cycling of belts made up of identical materials but differing in overall belt size and use in different copiers, duplicators and printers has exhibited different microdefects. Moreover, belts from different production runs have exhibited different microdefects when initially cycled in any given copier, duplicator and printer.

Various methods have been developed in the art to assess and/or accommodate the occurrence of the charge deficient spots. For example, U.S. Pat. Nos. 5,703,487 and 6,008,653 disclose processes for ascertaining the microdefect levels of an electrophotographic imaging member. The method of U.S. Pat. No. 5,703,487 comprises the steps of measuring either the differential increase in charge over and above the capacitive value or measuring reduction in voltage below the capacitive value of a known imaging member and of a virgin imaging member and comparing differential increase in charge over and above the capacitive value or the reduction in voltage below the capacitive value of the known imaging member and of the virgin imaging member.

U.S. Pat. No. 6,008,653 discloses a method for detecting surface potential charge patterns in an electrophotographic imaging member with a floating probe scanner. The scanner includes a capacitive probe, which is optically coupled to a probe amplifier, and an outer Faraday shield electrode connected to a bias voltage amplifier. The probe is maintained adjacent to and spaced from the imaging surface to form a parallel plate capacitor with a gas between the probe and the imaging surface. A constant voltage charge is applied to the imaging surface prior to establishing relative movement of the probe and the imaging surface. Variations in surface potential are measured with the probe and compensated for variations in distance between the probe and the imaging surface. The compensated voltage values are compared to a baseline voltage value to detect charge patterns in the electrophotographic imaging member. U.S. Pat. No. 6,119,536 describes the floating probe used in these measurements.

U.S. Pat. Nos. 5,591,554 and 5,576,130 disclose methods for preventing charge injection from substrates that give rise to CDS's. These patents disclose an electrophotographic imaging member including a support substrate having a two layered electrically conductive ground plane layer comprising a layer comprising zirconium over a layer comprising titanium, a hole blocking layer, and an adhesive layer. U.S. Pat. No. 5,591,554 describes an adhesive layer which includes a copolyester film forming resin, and an intermediate layer comprising a carbazole polymer, on which is coated a charge generation layer comprising a perylene or a phthalocyanine, and a hole transport layer, which is substantially non-absorbing in the spectral region at which the charge generation layer generates and injects photogenerated holes. U.S. Pat. No. 5,576,130 describes an adhesive layer that comprises a thermoplastic polyurethane film forming resin.

SUMMARY

Despite the various known photoreceptor designs, there remains a need in the art for methods to reduce the occurrence of charge deficient spots in the first instance and/or to mitigate their effect in the photoreceptor during use. If the occurrence of charge deficient spots can be reduced or eliminated, or if their effect in the photoreceptor during use can be mitigated, then resultant print quality using the photoreceptors will increase and photoreceptor production yield should also increase. Longer photoreceptor useful life is particularly desired, for example, because it makes image development and machine service more cost effective, and provides increased customer satisfaction.

The present disclosure addresses these and other needs by providing an improved photoreceptor design, comprising a three-layer photoconductive layer, where an intermediate layer is disposed between the charge generating layer and the charge transport layer. The intermediate layer suppresses the inordinately high injection of charge, which can almost become space charge limited from the localized spots that are the source of CDS's without altering too much the charge injection from the other areas of the generating layer to the charge transport layer and at the same time preventing any crystallization of charge transporting molecules.

In particular, the present disclosure provides an imaging member comprising:

a conductive substrate, a charge generating layer, a charge transport layer, and an intermediate layer disposed between the charge generating layer and the charge transport layer, comprising a hole transport material dispersed in a film forming binder.

The present disclosure also provides a process for forming an imaging member, comprising:

providing an imaging member conductive substrate, applying at least a charge generating layer over said conductive substrate;

applying an intermediate layer over said charge generating layer, said intermediate layer comprising whole transport material dispersed in a film forming binder; and applying a charge transport layer over said intermediate layer.

In an embodiment, the intermediate layer comprises at least two and preferably at least three different hole transport materials dispersed in a mixture of at least two different film forming binders.

BRIEF DESCRIPTION OF THE DRAWINGS

These and other advantages and features of this disclosure will be apparent from the following, especially when considered with the accompanying drawings, in which.

DETAILED DESCRIPTION OF PREFERRED EMBODIMENTS

Figure 1:
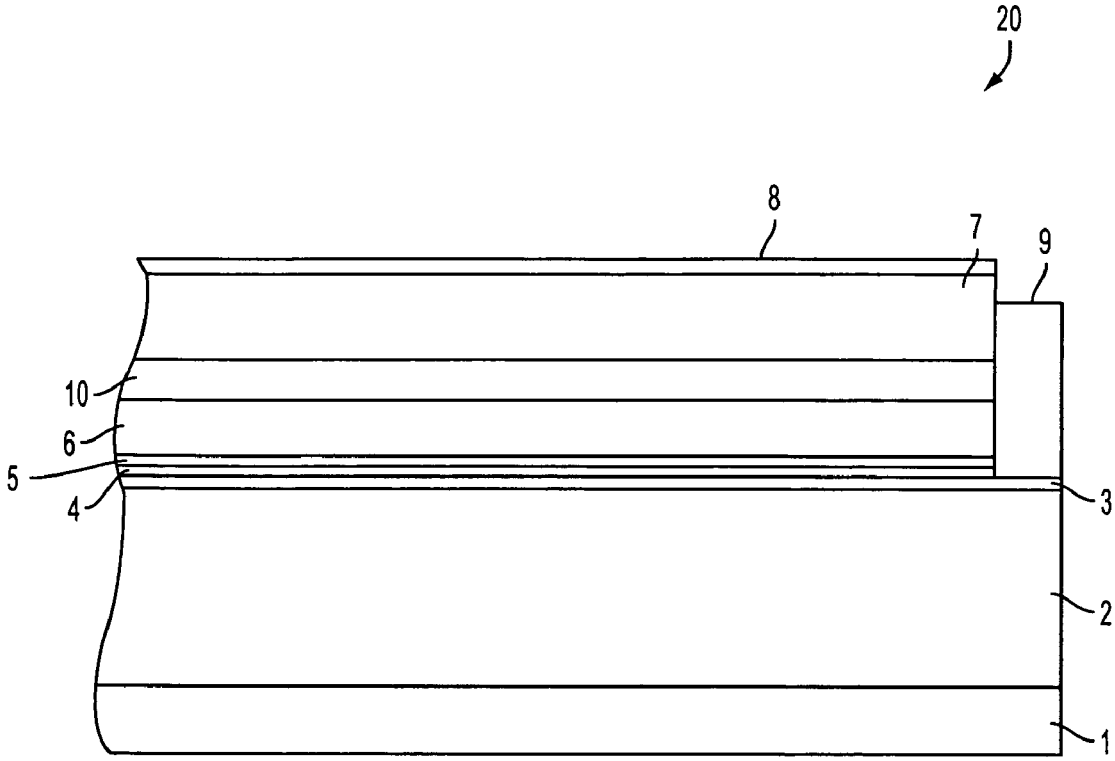
FIG. 1 is an exemplary diagram of a cross-section of an imaging member.

The present disclosure relates to imaging members (photoreceptors) comprising a three-layer photoconductive layer, where an intermediate layer is disposed between the charge generating layer and the charge transport layer Embodiments of the present disclosure are shown in FIG. 1, which is an exemplary diagram of a cross-section of an imaging member 20. The imaging member 20 may include an anti-curl layer 1, a substrate 2, an electrically conductive ground plane 3, a charge-blocking layer 4, an adhesive layer 5, a charge-generating layer 6, a charge-transport layer 7, an overcoating layer 8, and a ground strip 9. Although the imaging member 20 is shown as a photoreceptor, it should be appreciated that the imaging member 20 may be any member that forms or receives an image, and may include more or less layers without departing from the spirit and scope. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present disclosure, may be prepared by any of the various suitable techniques, provided that an intermediate layer as described below is interposed between the charge generating layer and the charge transport layer. Suitable conventional photoreceptor designs that can be modified in accordance with the present disclosure include, but are not limited to, those described for example in U.S. Pat. Nos. 4,265,990, 4,233,384, 4,306,008, 4,299,897, 4,439,507, 6,350,550, 6,376,141, 5,607,802, 5,591,554, 4,647,521, 4,664,995, 4,713,308, and 5,008,167, the entire disclosures of which are incorporated herein by reference.

U.S. Pat. Nos. 4,265,990, 4,233,384, 4,306,008, 4,299,897, and 4,439,507 disclose electrophotographic imaging members having at least two electrically operative layers including a charge generating layer and a transport layer comprising a diamine. U.S. Pat. No. 6,350,550 describes an electrophotographic member with mixed pigments. U.S. Pat. No. 6,376,141 describes an electrophotographic member with dual charge generating layers to enhance the sensitivity as well as the wavelength response. U.S. Pat. No. 5,830,614 relates to an imaging member comprising a support layer, a charge generating layer, a dual charge transport layer; the first layer in direct contact with the generator layer has higher concentration of charge transporting molecules than the second charge transporting layer coated on the top of the first charge transporting layer. U.S. Pat. No. 5,607,802 describes a multi-layered photoreceptor with dual under layers for improved adhesion and reduced micro-defects. In U.S. Pat. No. 5,591,554 an electrophotographic imaging member is disclosed including a support substrate having a two layered electrically conductive ground plane layer comprising a layer comprising zirconium over a layer comprising titanium a hole blocking layer, an adhesive layer comprising a copolyester film forming resin, an intermediate layer over and in contact with the adhesive layer, the intermediate layer comprising a carbazole polymer, a charge generation layer comprising a perylene or a phthalocyanine, and a hole transport layer. The entire disclosure of these patents is incorporated herein by reference in their entirety. These photoreceptor designs can also be modified in accordance with the present disclosure.

The particular construction of an exemplary imaging member will now be described in more detail. However, the following discussion is of only one embodiment, and is not limiting of the disclosure.

The substrate 1 may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multilayer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Any suitable blocking layer capable of forming an electronic barrier to holes between the adjacent photoconductive (charge generating) layer and the underlying conductive substrate layer may be utilized. The blocking layer may include film forming polymers, such as nylon, epoxy and phenolic resins. The polymeric blocking layer may also contain metal oxide particles, such as titanium dioxide or zinc oxide. The blocking layer may also include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$(gamma-aminopropyl)methyl diethoxysilane, mixtures thereof, and the like, as disclosed in U.S. Pat. No. 4,291,110. Also suitable is a siloxane film, such as disclosed in U.S. Pat. No. 4,464,450, which describes the use of a siloxane film comprising a reaction product of hydrolyzed siloxane or silane such as 3-amonotriethoxylsilane as a charge blocking layer coated on the ground plane. The entire disclosures of these patents are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer can be further doped with fillers, such as metal oxides, to improve its functionality. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 15 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, but are not limited to, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive or blocking layer, which in turn can then be overcoated with a contiguous intermediate layer and a contiguous hole (charge) transport layer as described hereinafter. Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Thickness outside these ranges can be selected providing the objectives of the present disclosure are achieved.

Any suitable and conventional technique may be utilized to mix and thereafter apply the photogenerating layer coating mixture. Typical application techniques include spraying, dip coating, roll coating, wire wound rod coating, gravure coating, extrusion die coating and the like. Drying of the deposited coating may be effected by any suitable conventional technique such as oven drying, infra red radiation drying, air drying and the like.

As shown in FIG. 1, the disclosure provides an intermediate layer 10 between the charge-generating layer 6 and the charge-transport layer 7. The intermediate layer generally comprises a hole transport material dispersed in a film forming binder, and preferably comprises a combination of two or more hole transport materials dispersed in a film forming binder comprising two or more binder materials. In embodiments, incorporation of such an intermediate layer reduces the undesirable effects attributed to the occurrence of charge deficient spots in the photoreceptor. In particular, it has been found that certain localized spots in the generator layer inject charge almost by the space charge limited current. These localized spots give rise to the micro defects in the discharged area described as "charge deficient spots." However, interposing an intermediate layer between the charge generating layer and the charge transport layer has been found to reduce the inordinately high injection from these spots without affecting too much the injection from other areas. Thus, while not eliminating the charge deficient spots themselves, the intermediate layer attenuates their effects, thereby rendering their existence less of a concern in terms of print quality.

To achieve these benefits, the intermediate layer comprises a hole transport material, preferably a combination of two or more hole transport materials, dispersed in a film forming binder, preferably comprising two or more binder materials. The hole transport material can be any suitable material that transports charge, including those hole transport materials that are well known in the art and described herein as suitable for use in other layers of the photoreceptor. Preferably, the hole transporting materials are selected from hole transporting small molecules. Exemplary hole transporting small molecules are disclosed, for example, in U.S. Pat. No. 5,882,829 and U.S. Patent Publication No. 2004/0126684, the entire disclosures of which are incorporated herein by reference.

For example, suitable hole transport materials include, but are not limited to, pyrazolines such as 1-phenyl-3-(4'-diethylamino styryl)-5-(4"-diethylaminophenyl)pyrazoline; monoamines such as aryl monoamines including bis(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, N,N-di-(3,4-dimethylphenyl)-4-biphenylamine (DBA), N,N-bis[4-methylphenyl]-N-[3-phenyldecanoate]amine (TTA-decyl), tri-p-tolylamine (TTA), and the like; diamines such as aryl diamines including those described in U.S. Pat. Nos. 4,306,008, 4,304,829, 4,233,384, 4,115,116, 4,299,897, 4,265,990, 4,081,274 and 6,214,514, the entire disclosures of which are incorporated herein by reference, such as N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, 1,1-bis (4-(p-tolyl)aminophenyl)cyclohexane (TAPC), N,N'-bis(4-methylphenyl)-N,N'-bis(4-ethylphenyl)-[1,1'-(3,3'-dimethyl)biphenyl]-4,4'-diamine, and the like; triamines such as aromatic triamines; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis (4-N,N'-diethylaminophenyl)-1,2,4-oxadiazole; stilbenes; mixtures thereof; and the like.

In embodiments, a combination of two or more hole transport materials is desired, as such a combination can help to reduce or avoid crystallization or phase separation of the charge transport material in the intermediate layer. For example, in embodiments, a combination of two or three or more different hole transport materials is desired, such as a combination of three different hole transport materials. In embodiments, combinations of two or more different hole transport materials are used, because the combination helps to reduce the possibility of localized crystallization, while retaining the desired charge mobility. That is, as higher amounts of a same different hole transport material are used, the possibility of localized crystallization increases as a result of closer proximity of the same materials. However, if lesser amounts are used to avoid localized crystallization, then the desired mobility can drop, even exponentially. By mixing two or more different hole transport materials, localized crystallization is avoided because there is less proximity of the same materials, and the desired mobility is retained. Accordingly, based on known or readily obtainable mobility measurements, a mixture of two or more hole transport materials can be used, in embodiments. For example, in one embodiment, the hole transport material is selected to be a combination of tri-p-tolylamine (TTA), 1,1-bis (4-(p-tolyl) aminophenyl) cyclohexane (TAPC), and N,N'-bis(4-methylphenyl)-N,N'-bis(4-ethylphenyl)-[1,1'-(3,3'-dimethyl)biphenyl]-4,4'-diamine. When two or more hole transport materials are used, they can be used in any relative amounts to obtain the desired result. Thus, for example, two hole transport materials can be used in relative amounts of from about 1:10 to about 10:1 parts by weight; and three hole transport materials can be used in relative amounts of from about 1-10:1-10:1-10 parts by weight. However, amounts outside these ranges could also be used. In the exemplary embodiment where three hole transport materials TTA, TAPC, and N,N'-bis(4-methylphenyl)-N,N'-bis(4-ethylphenyl)-[1,1'-(3,3'-dimethyl)biphenyl]-4,4'-diamine are used, they are used in about equal amounts by weight.

The hole transport materials of the intermediate layer are dispersed in a suitable binder material. The selection of binder or binders and hole transport materials should preferably eliminate or minimize crystallization or phase separation of the charge transport material in the intermediate layer. Further, the binder or binders should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates (including polymethacrylates), polyethers, polysulfones, polyvinyl chloride, polyvinylidene chloride, polystyrene, polyvinyl acetate, styrene-butadiene copolymer, styrene-alkyd resin, vinylidene chloride-acrylonitrile copolymer, vinyl chloride-vinyl acetate copolymer, vinyl chloride-vinyl acetate-maleic anhydride copolymer, silicones such as silicone hard coats, silicone-alkyd resin, phenol-formaldehyde resin, and mixtures thereof. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-500 and PCZ-400 polycarbonate resins and mixtures thereof. Examples of commercially available silicone hard coating agents include KP-85, X-40-9740 and X-40-2239 (produced by Shin-Etsu Silicone Co., Ltd.); AY42-440, AY42-441 and AY49-208 (produced by Toray Dow Corning Co., Ltd.); Dura-New-V-5 Hard coat (from California Hard coat Company); mixtures thereof; and the like.

Preferably, in embodiments, combination of two or more binder materials are used. This combination of two or more binder materials further helps to minimize crystallization or phase separation of the charge transport material in the intermediate layer, while also improving mechanical properties of the layer and of the entire photoreceptor. For example, the combination of binder materials can be selected to be two or more organic resins, an organic resin and a non-organic material, or two or more non-organic materials. In an exemplary embodiment, the combination of binder materials can be selected to be an organic resin, such as a polycarbonate resin, and a non-organic material, such as a silicone hard coat. For example, in embodiments, it is desired that the binder or binders be less polar materials, to improve charge injection from the charge generating layer to the charge transport layer.

In embodiments, a binder material that includes a silicone hard coat material, either alone or preferably in combination with another binder material, is preferred. Silicone hard coat materials are desirable, for example, because they are crosslinkable, the hole transport materials have lower solubility in this material than in other materials such as polycarbonate, and this material is a kind of hydrid nano-material, which is compatible with other organic/inorganic binders. Crosslinkability is desired in order to provide a desired binder layer. Lower solubility and increased compatibility are desired, for example, because they enable the binder materials to prevent leaching of hole transport materials from top layers during the coating process of the charge transport layer and homogenizing the hole transport material concentration. Higher concentration of hole transport material at the charge generator layer and the intermediate layer junction causes charge deficient spots, which are sought to be avoided.

When two or more binder materials are used, they can be used in any relative amounts to obtain the desired result. Thus, for example, two hole transport materials can be used in relative amounts of from about 1:10 to about 10:1 parts by weight, such as in relative amounts of from about 5:1 to about 1:5, or about 4:1 to about 1:4. However, amounts outside these ranges could also be used. In the exemplary embodiment where two binder materials polycarbonate and silicon hard coat are used, they are used in relative amounts of about 4 parts polycarbonate and 1 part silicone hard coat by weight.

The hole transport materials may be present in the binder composition in various suitable amounts. Generally, however, the hole transport materials may be present in the binder in an amount 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges. Any suitable and conventional technique may be utilized to mix and thereafter apply the intermediate layer coating mixture to the charge generating layer. Typical application techniques include spraying, dip coating, roll coating, Bird bar coating, wire wound rod coating, and the like. Drying of the deposited coating may be effected by any suitable conventional technique such as oven drying, infra-red radiation drying, air drying and the like.

Generally, the thickness of the intermediate layer is between about 0.01 and about 5 micrometers, such as between about 0.5 and about 2.5 microns, but thicknesses outside this range can also be used. For example, the thickness of the intermediate layer can be between about 1.0 and about 2 micrometers, such as about 1.5 micrometers.

Although the intermediate layer described above contains a binder and a hole transport material, it is distinct from the following described charge transport layer. The compositions of the two layers are different. That is, at least one of the binder materials or the hole transport materials of the two layers are different, and preferably both the binder materials and the hole transport materials of the two layers are different. For example, a polycarbonate binder for the charge transport layer would be different from a combined polycarbonate/silicone hard coat binder for the intermediate layer. The purposes and properties of the two layers are also different. For example, the charge transport layer generally includes a single charge transport molecule in a binder. The function of the charge transport layer is to move the charge fast without trapping any charge especially in deep traps, which would give rise to residual potential. The intermediate layer generally is thin compared to the charge transport layer on top of it and the function is to make charge injection from every point the same (i.e., spatially homogeneous charge injection).

The electrophotographic imaging member of the present disclosure contains a charge transport layer in addition to the charge generating layer and intermediate layer. The charge transport layer comprises any suitable organic polymer or non-polymeric material capable of transporting charge to selectively discharge the surface charge. Charge transport layers may be formed by any conventional materials and methods, such as the materials and methods disclosed in U.S. Pat. No. 5,521,047 to Yuh et al., the entire disclosure of which is incorporated herein by reference. In addition, the charge transport layer may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

The charge transport layer of the disclosure generally includes at least a binder and at least one arylamine charge transport material. The binder should eliminate or minimize crystallization of the charge transport material and should be soluble in a solvent selected for use with the composition such as, for example, methylene chloride, chlorobenzene, tetrahydrofuran, toluene or another suitable solvent. Suitable binders and charge transport material may include, for example, any of the binders and hole transport materials described above for use in the intermediate layer.

Typically, the charge transport material is present in the charge transport layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges. Any suitable and conventional technique may be utilized to mix and thereafter apply the charge transport layer coating mixture to the intermediate layer. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of the charge transport layer is between about 10 and about 50 micrometers, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An optional overcoat layer may then be applied over the charge transport layer. The overcoating layer may contain organic polymers or inorganic film-forming materials that are electrically insulating or slightly conductive, optionally including various known filler materials. The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred, in embodiments. However, because the overcoating layer is electron conductive, thicker overcoating layers can be employed in other embodiments. In these embodiments, the thickness can be between about 0.01 micrometer and about 20 micrometers in thickness.

Any suitable and conventional technique may be utilized to mix and thereafter apply the overcoat layer coating mixture to the charge transfer layer. Typical application techniques include spraying, dip coating, roll coating, wire wound rod coating, and the like. Drying of the deposited coating may be effected by any suitable conventional technique such as oven drying, infrared radiation drying, air drying and the like.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These anti-curl back coating layers are well known in the art and may comprise thermoplastic organic polymers or inorganic polymers that are electrically insulating or slightly semiconductive.

Any suitable conventional electrophotographic charging, exposure, development, transfer, fixing and cleaning techniques may be utilize to form and develop electrostatic latent images on the imaging member of this disclosure. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the disclosure has been described in conjunction with the specific embodiments described above, it is evident that many alternatives, modifications and variations are apparent to those skilled in the art. Accordingly, the preferred embodiments of the disclosure as set forth above are intended to be illustrative and not limiting. Various changes can be made without departing from the spirit and scope of the disclosure.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Coating Solution

A coating solution is prepared by mixing 0.3 grams silicone hard coat Dura-New-V-5 Hard Coat (from California Hard coat Company) and 0.3 grams polycarbonate PCZ-500 as binder materials, with 1.2 grams tri-p-tolylamine (TTA), 0.4 grams 1,1-bis(4-(p-tolyl)aminophenyl)cyclohexane (TAPC), and 0.4 grams N,N'-bis(4-methylphenyl)-N,N'-bis (4-ethylphenyl)-[1,1'-(3,3'-dimethyl)biphenyl]-4,4'-diamine. The mixture is dissolved in 37.3 grams of solvent tetrahydrofuran. The mixture is stirred slightly to provide a homogeneous solution. The resultant solution is ready for coating as an intermediate layer for a photoreceptor.

Example 2

Preparation of a Belt Coated Photoreceptor with Intermediate Layer

A belt electrophotographic imaging member is prepared. An imaging member is prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams 3-aminopropyltriethoxysilane, 41.2 grams water, 15 grams acetic acid, 684.8 grams of 200 proof denatured alcohol and 200 grams heptane. This layer is then dried for about 5 minutes at 135° C. in a forced air drier of the coater. The resulting blocking layer has a dry thickness of 500 Angstroms.

An adhesive layer is then prepared by applying a wet coating over the blocking layer, using a gravure applicator, containing 0.2 percent by weight based on the total weight of the solution of copolyester adhesive (ARDEL D100 available from Toyota Hsutsu Inc.) in a 60:30:10 volume ratio mixture of tetrahydrofuran, monochlorobenzene, methylene chloride. The adhesive layer is then dried for about 5 minutes at 135° C. in the forced air dryer of the coater. The resulting adhesive layer has a dry thickness of 200 Angstroms.

A photogenerating layer dispersion is prepared by introducing 0.45 grams of LUPILON® 200® (PCZ 200) available from Mitsubishi Gas Chemical Corp. and 50 ml of tetrahydrofuran into a 4 oz. glass bottle. To this solution are added 2.4 grams of hydroxygallium phthalocyanine (OHGaPc) and 300 grams of ⅛ inch (3.2 millimeter) diameter stainless steel shot. This mixture is then placed on a ball mill for 8 to 10 hours. Subsequently, 2.25 grams of PCZ 200 is dissolved in 46.1 gm of tetrahydrofuran, and added to this OHGaPc slurry. This slurry is then placed on a shaker for 10 minutes. The resulting slurry is, thereafter, applied to the adhesive interface with a Bird applicator to form a charge generation layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. The charge generation layer is dried at 135° C. for 5 minutes in a forced air oven to form a dry charge generation layer having a thickness of 0.4 micrometer.

On the charge generator layer is coated an intermediate layer, using the coating solution of Example 1. The solution is applied onto the charge generating layer with a Bird applicator to form an intermediate layer having a wet thickness of 1.0 mil. The coated device is then dried at 120° C. for 5 minutes to form an intermediate layer having a dry thickness of 1.5 micrometers.

On the intermediate layer is coated a charge transport layer containing 50 weight percent (based on the total solids) of a hole transport compound primarily consisting of N,N'-diphenyl-N,N'-bis(3-methyl-phenyl)-(1,1'-biphenyl)-4,4'-diamine. In a one ounce brown bottle, 1.2 grams Makrolon (PC-A from Bayer AG) is placed into 13.5 grams of methylene chloride and stirred with a magnetic bar. After the polymer is completely dissolved, 1.2 grams of N,N'-diphenyl-N,N'-bis(3-methylphenyl)-1,1'-biphenyl-4,4'-diamine is added. The mixture is stirred overnight to assure a complete solution. The solution is applied onto the intermediate layer using a 4 mil Bird bar to form a coating. The coated device is then heated in a forced hot air oven where the air temperature is elevated from about 40° C. to about 100° C. over a 30 minute period to form a charge transport layer having a dry thickness of 29 micrometers.

Comparative Example 2

Preparation of a Belt Coated Photoreceptor without Intermediate Layer

For comparison, a reference belt imaging device is prepared in the same manner of Example 2, except that the intermediate layer is omitted.

Following completion of the imaging members, the coating appearance of the imaging members of Example 2 (with intermediate layer) and Comparative Example 2 (without intermediate layer) are observed to be clear with a very uniform appearance.

The samples are tested on a Floating Probe CDS Scanner. This scanner records all the charge deletion spot (CDS) counts directly on the photoreceptors through a floating micro probe described earlier. This testing shows a CDS count of 8 Counts/cm$^2$ for the photoreceptor of Example 2 with the intermediate layer included below the transport layer, compared to a CDS count of 14 Counts/cm$^2$ for the photoreceptor of Comparative Example 2 where there is no intermediate layer. This test shows that the occurrence and/or effect of charge deletion spots is significantly reduced by the incorporation of an intermediate layer between the charge generating and charge transport layers.

The PIDC curves for the photoreceptor and the control photoreceptor are also obtained and measured.

The electrical properties of the prepared photoreceptor devices are tested in accordance with standard drum photoreceptor test methods. The electrical properties of the photoreceptor samples are evaluated with a xerographic testing scanner. In the scanner, each photoreceptor sheet to be evaluated is mounted on a cylindrical aluminum drum substrate that is rotated on a shaft. The devices are charged by a corotron mounted along the periphery of the drum. The surface potential is measured as a function of time by capacitively coupled voltage probes placed at different locations around the shaft. The probes are calibrated by applying known potentials to the drum substrate. Each photoreceptor sheet on the drum is exposed to a light source located at a position near the drum downstream from the corotron. As the drum is rotated, the initial (pre-exposure) charging potential is measured by a voltage probe. Further rotation lead to an exposure station, where the photoreceptor device is exposed to monochromatic radiation of a known intensity. The devices are erased by a light source located at a position upstream of charging. The devices are charged to a negative polarity corona. The surface potential after exposure is measured by a second voltage probe. The devices are finally exposed to an erase lamp of appropriate intensity and any residual potential is measured by a third voltage probe. The process is repeated with the magnitude of the exposure automatically changed during the next cycle. The photodischarge characteristics are obtained by plotting the potentials at a voltage probe as a function of light exposure.

The test sample is first rested in the dark for at least 60 minutes to ensure achievement of equilibrium with the testing conditions at 50 percent relative humidity and 72° F. The sample is then negatively charged in the dark to a potential of about 800 volts. The test procedure is repeated to determine the photo induced discharge characteristic (PIDC) of the sample by different light energies of up to 40 ergs/cm$^2$.

Figure 2:
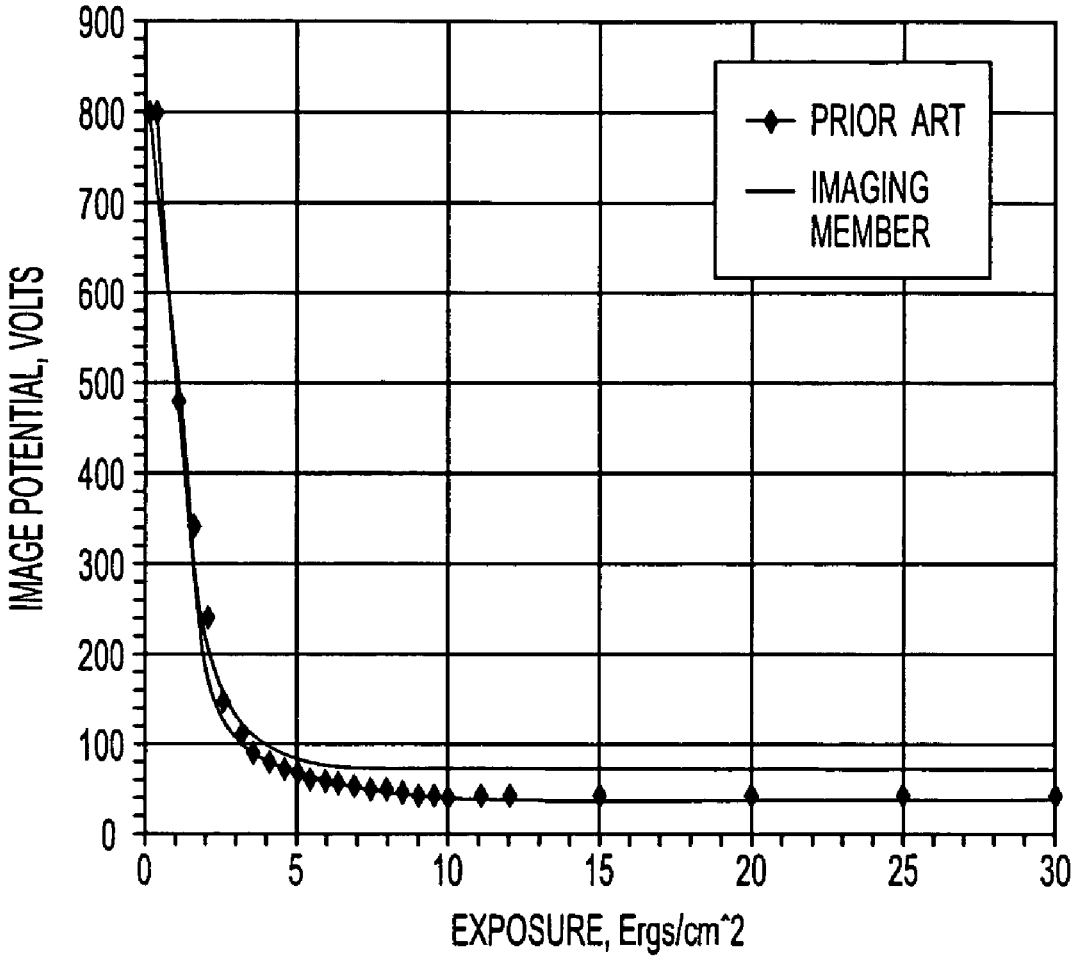
FIG. 2 is a PIDC curve for imaging members described in the Examples.

The electrical properties are shown in the following Table, and the PIDC curves are shown in FIG. 2.

| Example | V0 | S | Vc | Vr | Vdepl | Vdd |
|---|---|---|---|---|---|---|
| Ex. 2 | 797.374 | 342.960 | 169.498 | 35.612 | 15.59 | 38.77 |
| Comp. Ex. 2 | 797.995 | 380.630 | 128.928 | 64.535 | 28.23 | 29.28 |

With reference to the abbreviations employed in Table 1:
V0 is the dark voltage after scorotron charging
S is the initial slope of the PIDC curve and is a measurement of sensitivity
Vc is the potential at the half way point of slope S
Vr is the residual potential after light erase
Vdepl is a linearly extrapolated value from the surface potential versus charge density relation of the device, and is a measurement of voltage leakage during charging
Vdd is the lost potential before light exposure Comparison of the PIDC curves for Example 2 and Comparative Example 2 show no significant differences. The testing indicates that addition of the intermediate layer does not have any negative effect on the electrical performance of the imaging member, while providing the positive effect of significantly reducing the occurrence and/or effect of charge deletion spots.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An imaging member comprising:
a conductive substrate,
a charge generating layer,
a charge transport layer, comprising at least one charge transport material dispersed in at least one binder, and
an intermediate layer disposed between the charge generating layer and the charge transport layer, comprising two or more different hole transport materials dispersed in a film forming binder, wherein at least one of the hole transport materials and the film forming binder of the intermediate layer is different from the respective charge transport material and binder of the charge transport layer.

2. The imaging member of claim 1, wherein the combination of two or more different hole transport materials prevents crystallization of the hole transport materials in the film forming binder.

3. The imaging member of claim 1, wherein the film forming binder comprises at least two binder materials, at least one of which is a silicone hard coat material selected to prevent leaching of the hole transport material into the charge generating layer.

4. The imaging member of claim 1, wherein the intermediate layer comprises at least three different hole transport materials dispersed in a film forming binder comprising at least two binder materials.

5. The imaging member of claim 1, wherein the hole transport material is selected from the group consisting of pyrazolines; monoamines; diamines; triamines; hydrazones; oxadiazoles; stilbenes; and mixtures thereof.

6. The imaging member of claim 1, wherein the hole transport material comprises two or more different hole transfer materials, at least one of which is a diamine and at least one of which is a material that is not a diamine.

7. The imaging member of claim 1, wherein the hole transport material comprises at least three different hole transfer materials, comprising tri-p-tolylamine, 1,1-bis (4-(p-tolyl) aminophenyl) cyclohexane, and N,N'-bis(4-methylphenyl)-N,N'-bis(4-ethylphenyl)-[1,1 '-(3,3 '-dimethyl)biphenyl]-4, 4'-diamine.

8. The imaging member of claim 1, wherein the binder is selected from the group consisting of polycarbonates, polyesters, polyarylates, polyacrylates, polyethers, polysulfones, polyvinyl chloride, polyvinylidene chloride, polyvinyl acetate, styrene-butadience copolymer, styrene-alkyd resin, vinylidene chloride-acrylonitrile copolymer, vinyl chloride-vinyl acetate copolymer, vinyl chloride-vinyl acetate-maleic anhydride copolymer, silicones, silicone-alkyd resin, phenol-formaldehyde resin, and mixtures thereof.

9. The imaging member of claim 1, wherein the binder comprises two or more different binder materials, comprising polycarbonate and a silicone hard coat.

10. The imaging member of claim 1, wherein the intermediate layer comprises from about 5 to about 80 percent by weight hole transfer material and from about 20 to about 95 percent by weight binder.

11. The imaging member of claim 1, wherein the intermediate layer prevents high dark injection from spatially localized spots and gives uniform injection to the charge transport layer as compared to a similar imaging member not including the intermediate layer.

12. The imaging member of claim 1, wherein the intermediate layer has a thickness of from about 0.5 and about 5 micrometers.

13. An imaging member comprising:
a conductive substrate,
a charge generating layer,
a charge transport layer, and
an intermediate layer disposed between the charge generating layer and the charge transport layer, comprising at least three different hole transport materials dispersed in a mixture of at least two different film forming binders.

14. A process for forming an imaging member, comprising:
providing an imaging member conductive substrate,
applying at least a charge generating layer over said conductive substrate;
applying an intermediate layer over said charge generating layer, said intermediate layer comprising two or more hole transport materials dispersed in a film forming binder; and
applying a charge transport layer over said intermediate layer wherein said charge transport layer comprises at least one charge transport material dispersed in at least one binder and wherein at least one of the charge transport material and binder of said charge transport layer is different from at least one of the respective hole transport materials and film forming binder of said intermediate layer.

15. The process of claim 14, wherein the intermediate layer comprises at least three different hole transport materials dispersed in a film forming binder comprising at least two binder materials.

16. The process of claim 14, wherein the hole transport material is selected from the group consisting of pyrazolines; monoamines; diamines; triamines; hydrazones; oxadiazoles; stilbenes; and mixtures thereof.

17. The process of claim 14, wherein the hole transport material comprises two or more different hole transfer materials, at least one of which is a diamine and at least one of which is a material that is not a diamine.

18. The process of claim 14, wherein the hole transport material comprises at least three different hole transfer materials, comprising tri-p-tolylamine, 1,1-bis (4-(p-tolyl) aminophenyl) cyclohexane, and N,N'-bis(4-methylphenyl)-N, N'-bis(4-ethylphenyl)-[1,1'-(3,3'-dimethyl)biphenyl]-4,4'-diamine.

19. The process of claim 14, wherein the binder is selected from the group consisting of polycarbonates, polyesters, polyarylates, polyacrylates, polyethers, polysulfones, polyvinyl chloride, polyvinylidene chloride, polyvinyl acetate, styrene-butadiene copolymer, styrene-alkyd resin, vinylidene chloride-acrylonitrile copolymer, vinyl chloride-vinyl acetate copolymer, vinyl chloride-vinyl acetate-maleic anhydride copolymer, silicones, silicone-alkyd resin, phenol-formaldehyde resin, and mixtures thereof.

20. The process of claim 14, wherein the binder comprises two or more different binder materials, comprising polycarbonate and a silicone hard coat.

21. An electrographic image development device, comprising the imaging member of claim 1.

* * * * *